US012753755B2

(12) United States Patent
Patterson et al.

(10) Patent No.: US 12,753,755 B2
(45) Date of Patent: Oct. 6, 2026

(54) SEGMENTED FLUID END MODULE

(71) Applicant: FORUM US, INC., Houston, TX (US)

(72) Inventors: Stephen Patterson, Westhill (GB); Francis Santos, San Antonio, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 18/933,490

(22) Filed: Oct. 31, 2024

(65) Prior Publication Data

US 2026/0117765 A1 Apr. 30, 2026

(51) Int. Cl.
*F04B 53/16* (2006.01)
*F04B 53/22* (2006.01)
*F04B 47/00* (2006.01)

(52) U.S. Cl.
CPC ..... *F04B 53/16* (2013.01); *F04B 53/22* (2013.01); *F04B 47/00* (2013.01)

(58) Field of Classification Search
CPC ..... F04B 53/16; F04B 53/22
See application file for complete search history.

(56) References Cited

U.S. PATENT DOCUMENTS 3,427,988 A * 2/1969 Schmieman ..... F04B 53/10 417/569
5,171,136 A * 12/1992 Pacht ..... F04B 53/1025 417/571
8,465,268 B2 6/2013 Baxter et al.
8,528,462 B2 * 9/2013 Pacht ..... F04B 53/147 92/147
8,701,546 B2 * 4/2014 Pacht ..... F04B 1/0408 92/147
8,998,593 B2 4/2015 Vicars
9,243,630 B2 1/2016 Foote
9,791,082 B2 10/2017 Baxter et al.
9,816,494 B2 11/2017 Dille
10,184,470 B2 1/2019 Barnett, Jr.
10,221,847 B2 * 3/2019 Dyer ..... F04B 39/10
10,760,567 B2 * 9/2020 Salih ..... F04B 47/02
11,294,402 B1 * 4/2022 Baskin ..... F04B 53/007
11,560,887 B2 1/2023 Hinderliter et al.
2008/0080992 A1 * 4/2008 Cummins ..... F04B 15/02 417/404
2019/0154035 A1 * 5/2019 Cordes ..... F04B 53/007
2024/0240634 A1 * 7/2024 Kay ..... F04B 53/16

OTHER PUBLICATIONS

Combined Search and Examination Report from British Patent Application No. 2516308.0 dated Feb. 25, 2026.

* cited by examiner

*Primary Examiner* — Thomas E Lazo
(74) *Attorney, Agent, or Firm* — Patterson + Sheridan, LLP

(57) ABSTRACT

A segmented fluid end module comprises a first, second, and third body each comprising a bore formed therethrough. The first body is coupled to an upper end of the second body by a first plurality of fasteners that extend through the first body. The bore of the first body is in fluid communication with the bore of the second body. The third body is coupled to a side of the second body by a second plurality of fasteners that extend through the third body. The bore of the third body is in fluid communication with the bore of the second body. A pump system comprises the segmented fluid end module, a suction manifold coupled to the first body, a discharge manifold coupled to the third body, and a power end comprising a plunger that extends into the second body.

15 Claims, 6 Drawing Sheets

SEGMENTED FLUID END MODULE

BACKGROUND

Field

Embodiments described herein generally relate to segmented fluid end modules for pump systems used in wellbore drilling operations.

Description of the Related Art

Pump systems used in wellbore drilling operations are subject to severe operating conditions and require frequent maintenance. These pump systems, and specifically the fluid ends of the pump system, are difficult to service due the large size and heavy weight of the components of the pump systems. Therefore, there is a need for new and/or improved pump systems that are quicker and easier to service.

SUMMARY

In one or more embodiments, a segmented fluid end module comprises a first body comprising a bore formed through the first body; a second body comprising a bore formed through the second body; and a third body comprising a bore formed through the third body. The first body is coupled to an upper end of the second body by a first plurality of fasteners that extend through the first body. The bore of the first body is in fluid communication with the bore of the second body. The third body is coupled to a side of the second body by a second plurality of fasteners that extend through the third body. The bore of the third body is in fluid communication with the bore of the second body.

In one or more embodiments, a pump system comprises a segmented fluid end module comprising a first, second, and third body each comprising a bore formed therethrough; a suction manifold coupled to the first body; a discharge manifold coupled to the third body; and a power end comprising a plunger that extends into the second body.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The present disclosure contemplates that use of terms such as "coupled," "couples", and/or "coupling," can include direct coupling and/or indirect coupling, such as coupling through other components. The present disclosure also contemplates that use of terms such as "coupled," "couples", and/or "coupling," can include but are not limited to connecting, welding, interference fitting, brazing, and/or fastening using fasteners, such as pins, rivets, screws, bolts, and/or nuts. The present disclosure also contemplates that use of terms such as "coupled," "couples", and/or "coupling," can include but are not limited to components being integrally formed together as a unitary body.

Embodiments disclosed herein relate to a segmented fluid end module of a pump system that can be more quickly and easily disassembled for maintenance and/or repair. The pump system may be a mud pump configured to pump fluid into a wellbore during a wellbore drilling operation. One or more bodies (e.g. modules) of the segmented fluid end module are coupled together by a plurality of fasteners. One body of the segmented fluid end module can be uncoupled from another body of the segmented fluid end module without having to disassemble the entire segmented fluid end module.

Figure 1:
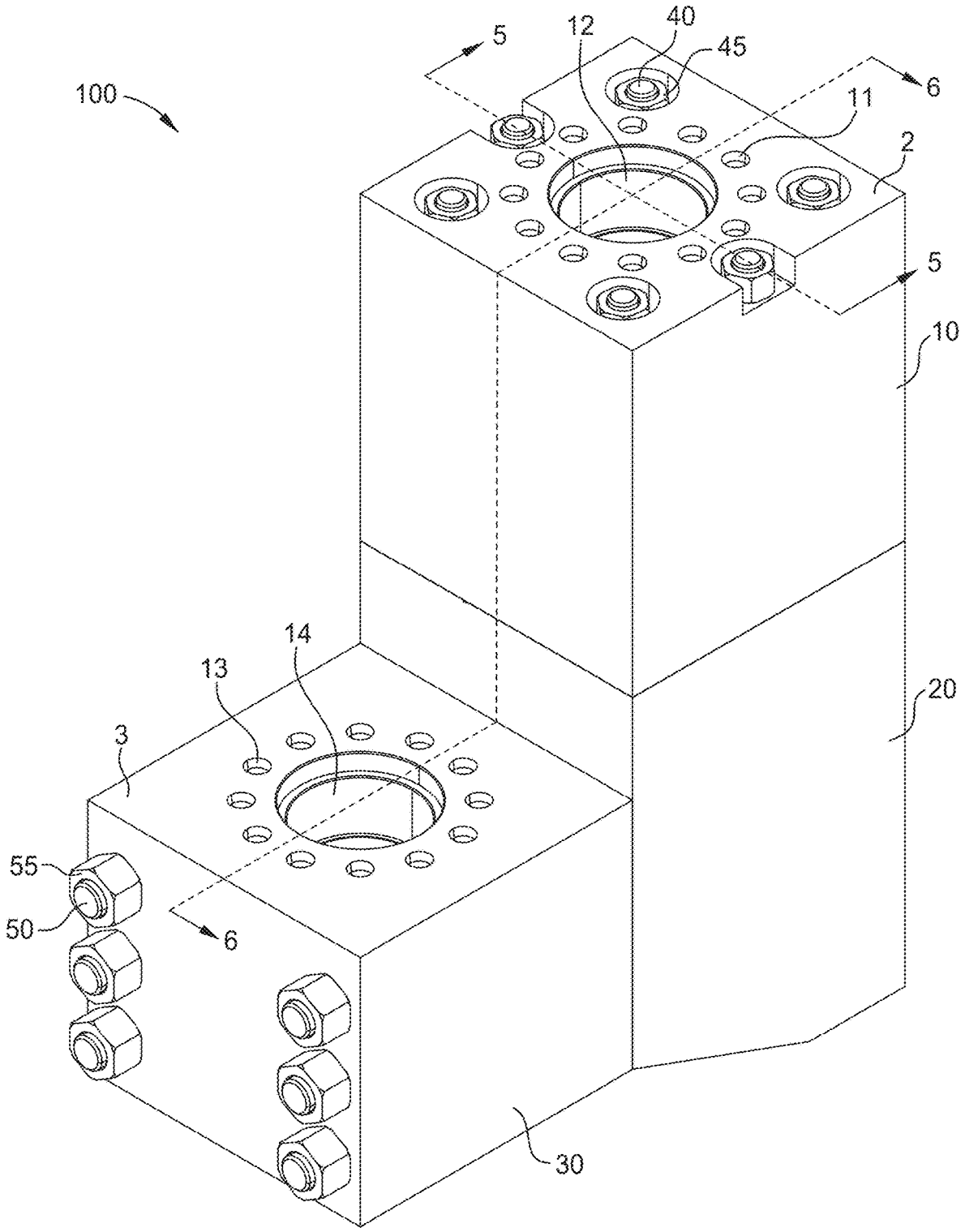
FIG. 1 is a first perspective view of a segmented fluid end module, according to one or more embodiments.

FIG. 1 is a first perspective view of a segmented fluid end module 100 of a pump system, according to one or more embodiments. The segmented fluid end module 100 comprises a first body 10, a second body 20, and a third body 30. The first body 10 is coupled to an upper end of the second body 20 by a plurality of threaded fasteners comprising threaded rods 40 and nuts 45. Although six (6) threaded rods 40 and nuts 45 are shown, any number of threaded fasteners can be used. The third body 30 is coupled to a side of the second body 20 by a plurality of threaded fasteners comprising threaded rods 50 and nuts 55. Although six (6) threaded rods 50 and nuts 55 are shown, any number of threaded fasteners can be used. The first, second, and third bodies 10, 20, 30 are coupled together such that the respective bottom, top, and side surfaces are flush against each other (e.g. there is no raised or flange-type connection between the first body 10 and the second body 20, or between the second body 20 and the third body 30).

Figure 6:
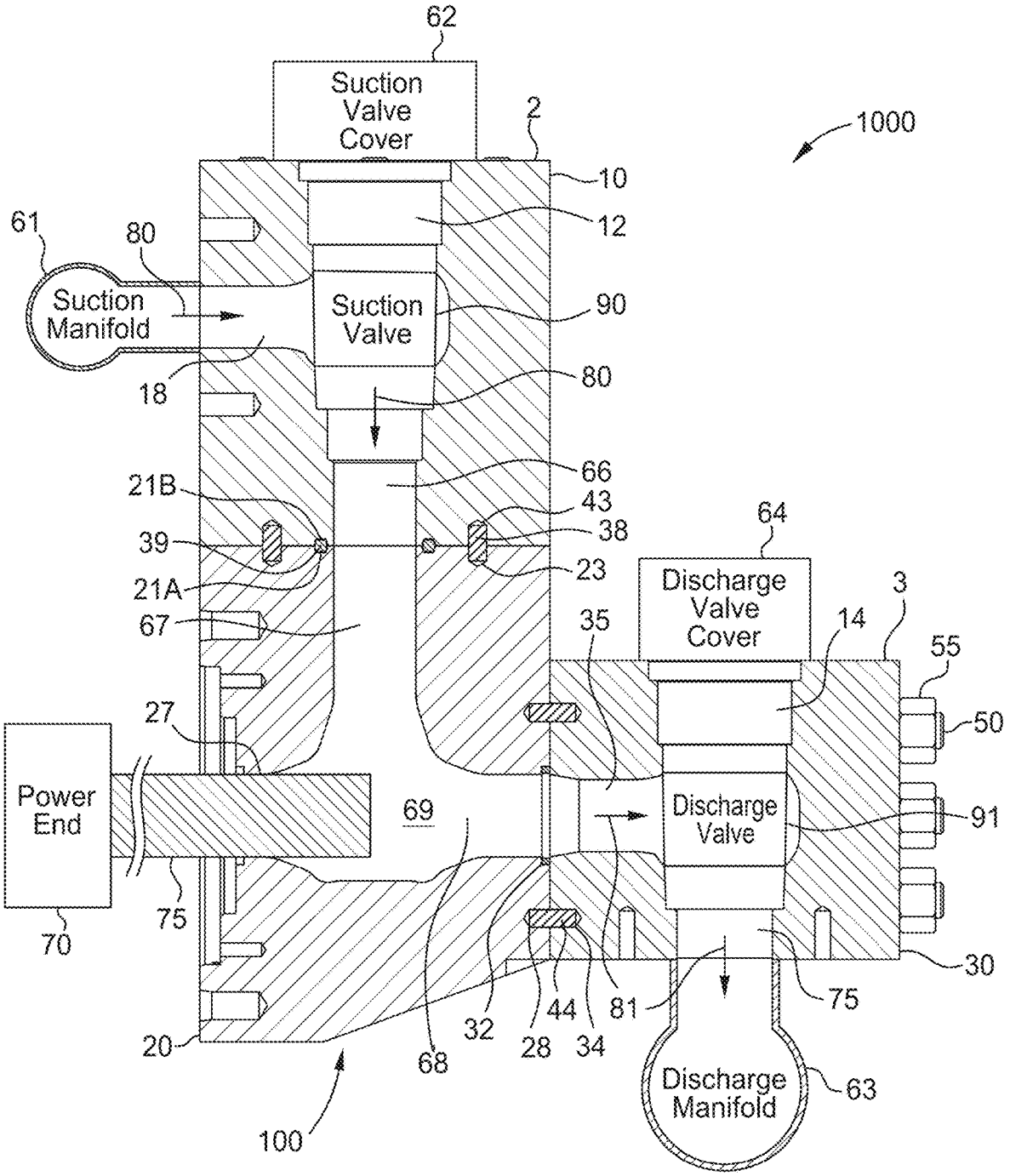
FIG. 6 is a cross-sectional view of a pump system comprising the segmented fluid end module, according to one or more embodiments.

An upper bore 12 is formed through an upper end 2 of the first body 10. A plurality of threaded bores 11 are formed in the first body 10 around the upper bore 12. The plurality of threaded bores 11 may be used to couple a valve cover (as shown in FIG. 6) to the first body 10 to seal the upper bore 12. An upper bore 14 is formed through an upper end 3 of the third body 30. A plurality of threaded bores 13 are formed in the third body 30 around the upper bore 14. The plurality of threaded bores 13 may be used to couple a valve cover (as shown in FIG. 6) to the third body 30 to seal the upper bore 14.

Figure 2:
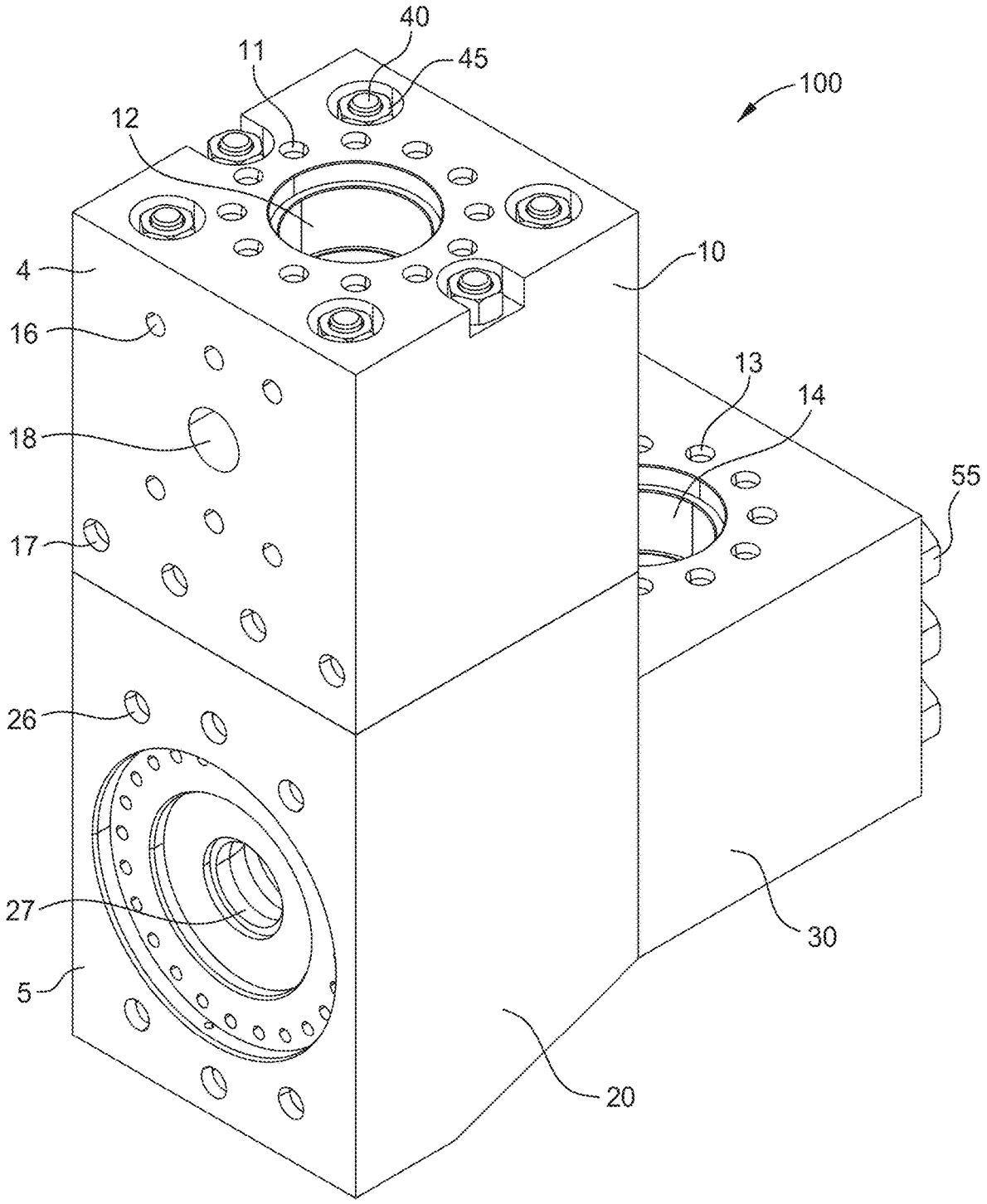
FIG. 2 is a second perspective view of the segmented fluid end module, according to one or more embodiments.

FIG. 2 is a second perspective view of the segmented fluid end module 100, according to one or more embodiments. A side bore 18 is formed through a side 4 of the first body 10 and intersects the upper bore 12. A plurality of threaded bores 16, 17 are formed in the side 4 of the first body 10 adjacent to the side bore 18. The plurality of threaded bores 16, 17 may be used to couple a manifold (as shown in FIG. 6) to the first body 10 that seals with the side bore 18. A side bore 27 is formed through a side 5 of the second body 20. A plurality of threaded bores 26 are formed in the side 5 of the second body 20 adjacent to the side bore 27. The plurality of threaded bores 26 may be used to couple a manifold (as shown in FIG. 6) to the first body 10 that seals with the side bore 18.

Figure 3:
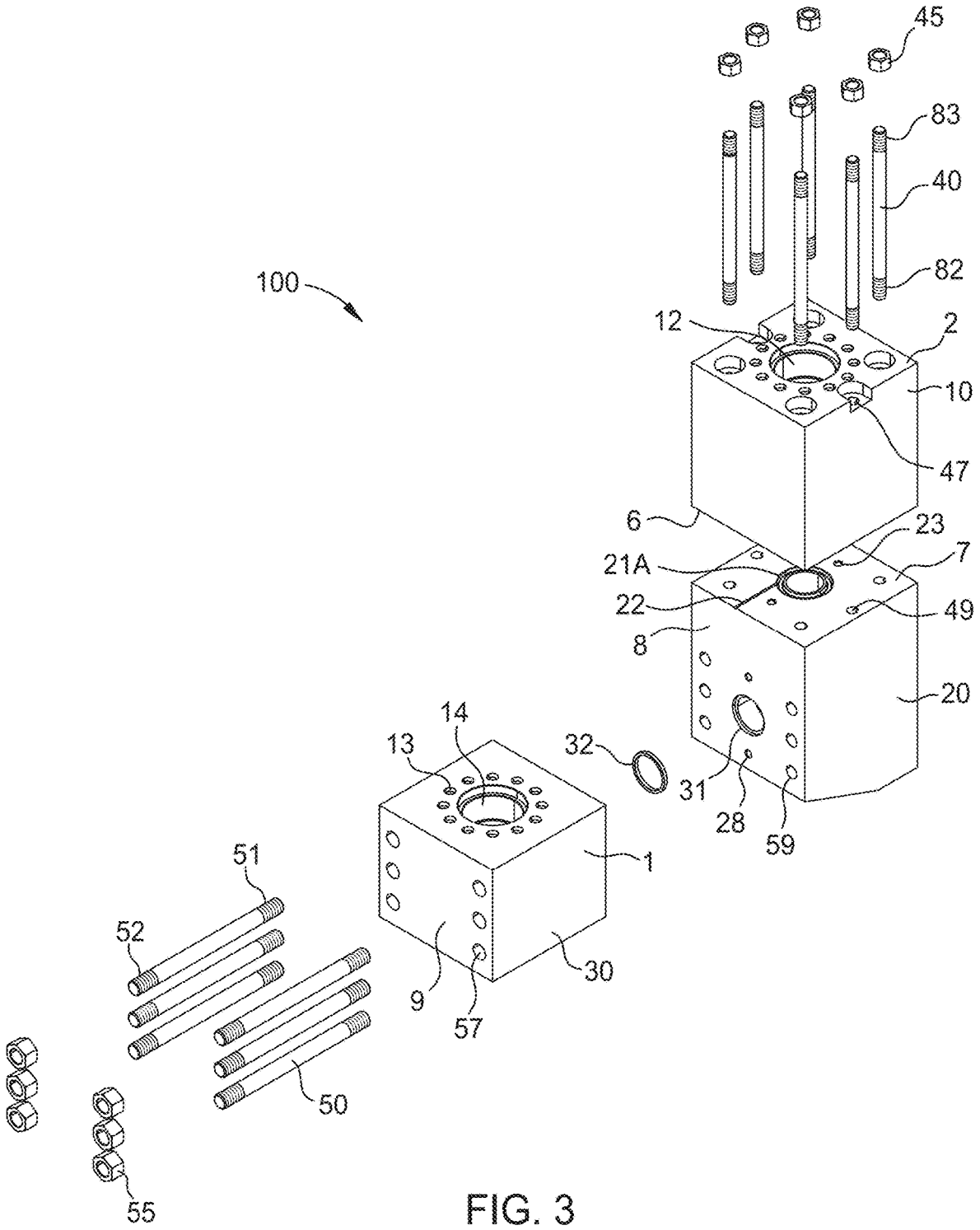
FIG. 3 is a first exploded view of the segmented fluid end module, according to one or more embodiments.
Figure 4:
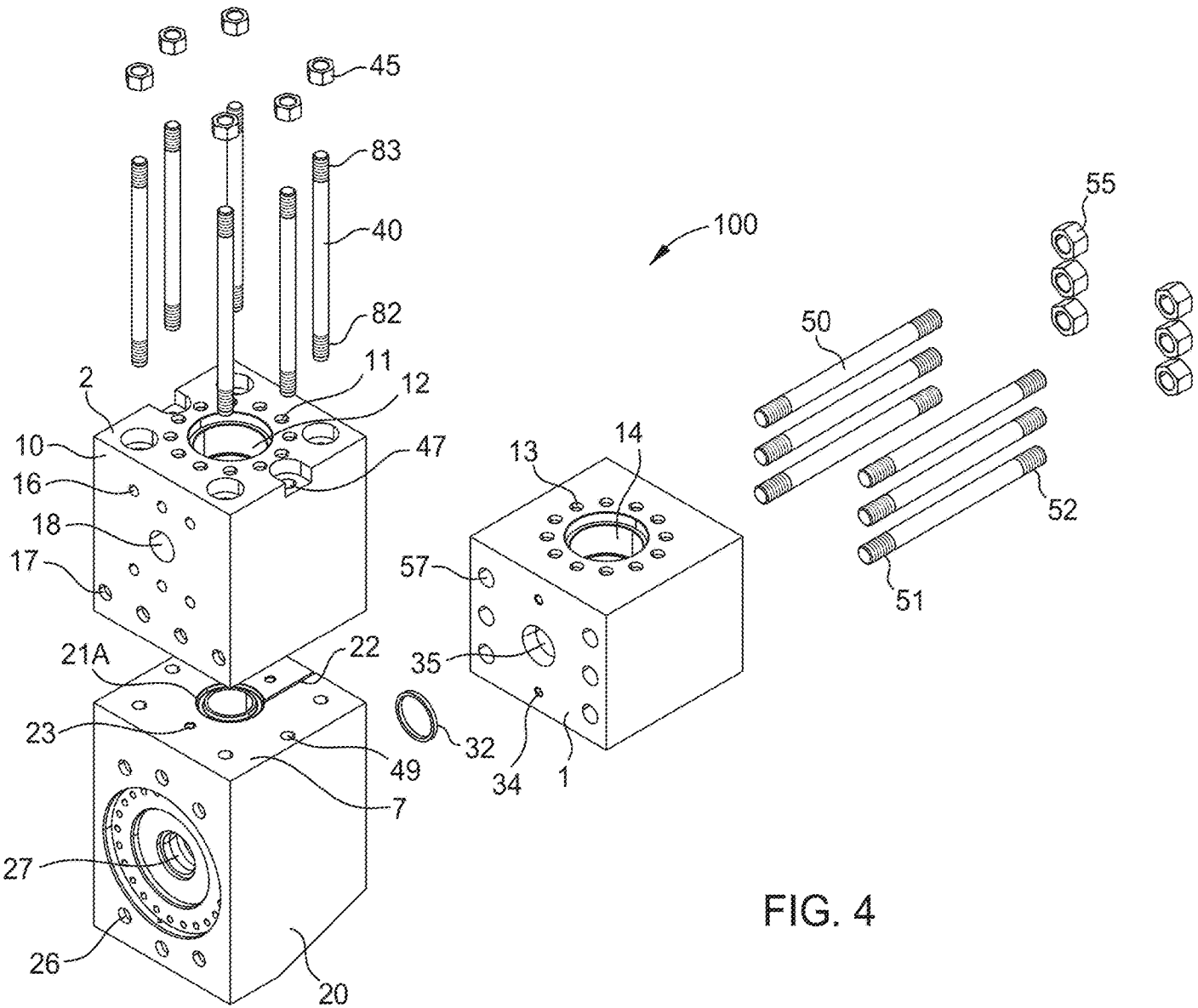
FIG. 4 is a second exploded view of the segmented fluid end module, according to one or more embodiments.

FIG. 3 is a first exploded view of the segmented fluid end module, according to one or more embodiments. FIG. 4 is a second exploded view of the segmented fluid end module, according to one or more embodiments. With reference to FIGS. 3 and 4, a plurality of bores 47 are formed through the first body 10 from the upper end 2 to a lower end 6. Except for counterbores formed in the upper end 2 of the first body 10, the bores 47 extend through the entire length of the first body 10 from top to bottom. The threaded rods 40 are positioned in the bores 47. As illustrated, only the upper and lower ends 83, 82 of the threaded rods 40 comprise threads. Alternatively, the entire length of the threaded rods 40 may comprise threads. The lower ends 82 of the threaded rods 40 thread into corresponding bores 49 (which may be threaded bores) formed in an upper end 7 of the second body 20. The nuts 45 thread onto the upper ends 83 of the threaded rods 40 and against the upper end 2 of the first body 10 to couple the first body 10 to the second body 20. In this manner, the first body 10 is removably coupled to the second body 20 by the plurality of fasteners.

One or more alignment pin holes 23 are formed in the upper end 7 of the second body 20 to help align the first body 10 with the second body 20. A seal groove 21A is formed in the upper end 7 of the second body 20. A lubrication channel 22 is formed in the upper end 7 of the second body 20 to provide lubrication to the seal groove 21A. One or more alignment pin holes 28 are formed in a side 8 of the second body 20 to help align the second body 20 with the third body 30. A seal groove 31 is formed in the side 8 of the second body 20, in which a seal 32 is located to form a seal between the second body 20 and the third body 30. The seal 32 forms a seal about a side bore 35 formed in the third body 30, which intersects the upper bore 14.

A plurality of bores 57 are formed through the third body 30 from one side 9 to an opposite side 1. The bores 57 extend through the entire length of the third body 30 from side to side. The threaded rods 50 are positioned in the bores 57. As illustrated, only the upper and lower ends 52, 51 of the threaded rods 50 comprise threads. Alternatively, the entire length of the threaded rods 50 may comprise threads. The lower ends 51 of the threaded rods 50 thread into corresponding threaded bores 59 formed in the side 8 of the second body 20. The nuts 55 thread onto the upper ends 52 of the threaded rods 50 and against the side 9 of the third body 30 to couple the third body 30 to the second body 20. In this manner, the third body 30 is removably coupled to the second body 20 by the plurality of fasteners.

Figure 5:
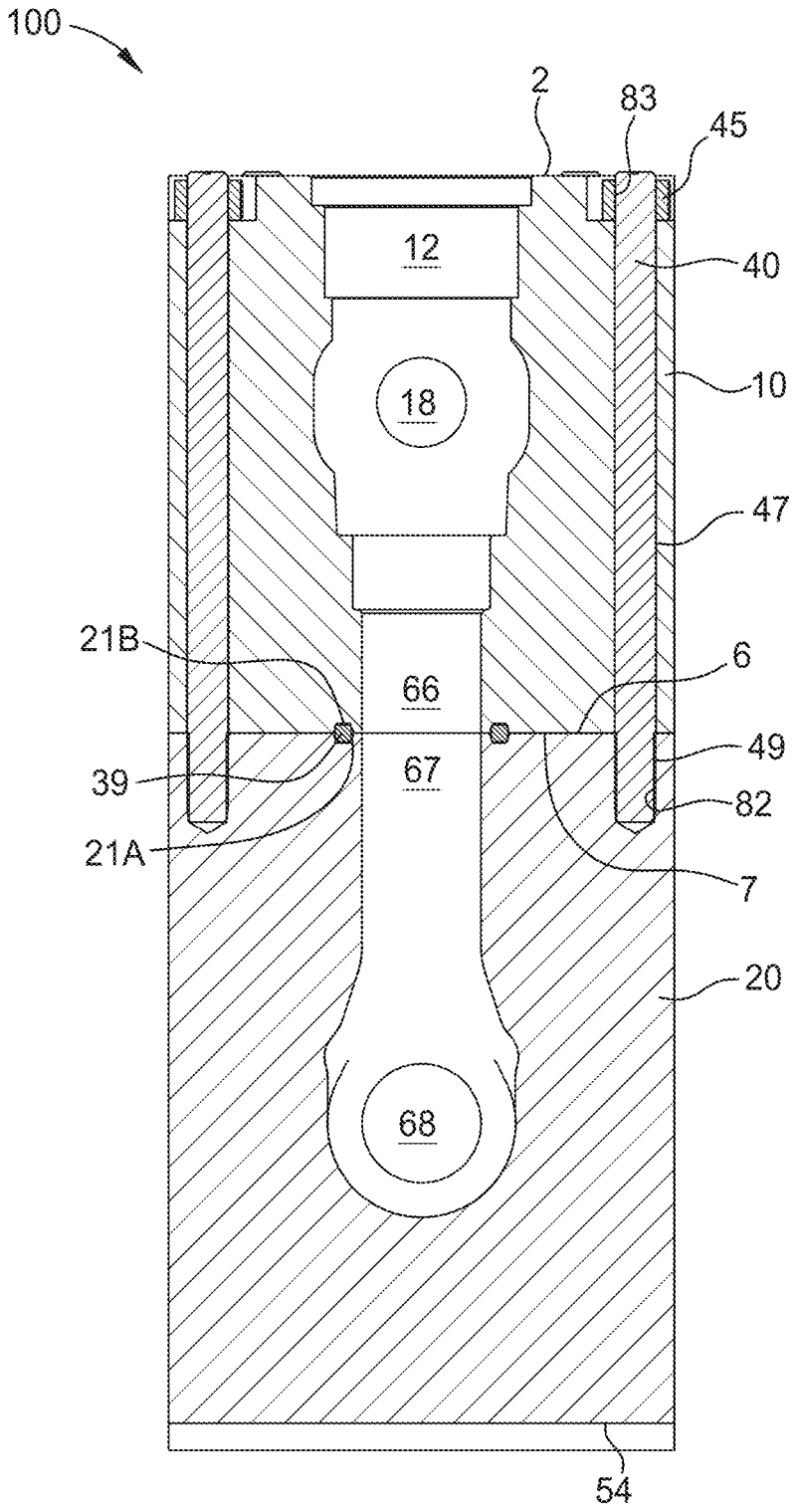
FIG. 5 is a cross-sectional view of the segmented fluid end module, according to one or more embodiments.

FIG. 5 is a cross-sectional view of the segmented fluid end module 100, and specifically through the first body 10 and the second body 20, according to one or more embodiments. Each threaded rod 40 is positioned in a respective bore 47 formed through the first body 10 from the upper end 2 to the lower end 6. The lower ends 82 of the threaded rods 40 thread into the corresponding bores 49 (which may be threaded bores) formed in the upper end 7 of the second body 20. The nuts 45 are threaded onto the upper ends 83 of the threaded rods 40 and against the upper end 2 of the first body 10 to couple the first body 10 to the second body 20. The seal 39 is positioned in the seal groove 21A formed in the second body 20 and in a corresponding seal groove 21B formed in the first body 10 to form a seal between a lower bore 66 of the first body 10 and an upper bore 67 of the second body 20. The lower bore 66 intersects the upper bore 12 and the side bore 18 of the first body 10. The upper bore 67 intersects a side bore 68 of the second body 20.

As shown in FIG. 5, the bores 49 do not extend all the way through the second body 20. The bores 49 extend partially into the second body 20. The first body 10 can be uncoupled from the second body 20 by removing the nuts 45 from the upper ends 83 of threaded rods 40 and then moving (e.g. lifting) the first body 10 from the second body 20 relative to and while the threaded rods 40 remain coupled to the bores 49 of the second body 20. Alternatively, after removing the nuts 45, the threaded rods 40 can be unthreaded from the bores 49 of the second body 20 and removed from the bores 47 of the first body 10 to then move the first body 10 from the second body 20.

In one or more embodiments, the bores 49 do extend all the way through the second body 20 from the upper end 7 to a lower end 54. The threaded rods 40 may be long enough to extend from the upper end 2 of the first body 10 to and through the lower end 54 of the second body 20. One or more additional nuts may be threaded onto the lower ends 82 of the threaded rods 40 that extend from the lower end 54 of the second body 20 and against the lower end 54 to couple the first body 10 to the second body 20.

FIG. 6 is a cross-sectional view of a pump system 1000, according to one or more embodiments. The pump system 1000 may be a mud pump configured to pump fluid into a wellbore during a wellbore drilling operation. The pump system 1000 comprises the segmented fluid end module 100, a suction manifold 61 coupled to the first body 10, a power end 70 coupled to the second body 20, and a discharge manifold 63 coupled to the third body 30. The section manifold 61, the power end 70, and the discharge manifold 63 are schematically illustrated.

The suction manifold 61 is in fluid communication with the side bore 18 of the first body 10. A suction valve 90, which may be a check valve, is positioned within the first body 10. The suction valve 90 allows fluid from the suction manifold 61 to flow from the side bore 18 to the lower bore 66 in one direction (as indicted by reference arrows 80) while preventing fluid flow in the opposite direction. A suction valve cover 62 is coupled to the upper end 2 of the first body 10 to seal the upper bore 12 of the first body 10.

The lower bore 66 of the first body 10 is in fluid communication with the upper bore 67 of the second body 20, which are sealed by the seal 39 located in the corresponding seal grooves 21A, 21B. One or more alignment pins 38 are located in corresponding alignment pin holes 23, 43 of the first and second bodies 10, 20. The alignment pins 38 help align the first body 10 relative to the second body 20 when coupling the first and second bodies 10, 20 together.

The discharge manifold 63 is in fluid communication with a lower bore 73 of the third body 30. A discharge valve 91, which may be a check valve, is positioned within the third body 30. The discharge valve 91 allows fluid from the second body 20 to flow from the side bore 35 to the lower bore 73 and out to the discharge manifold 63 in one direction (as indicted by reference arrows 81) while preventing fluid flow in the opposite direction. A discharge valve cover 64 is coupled to the upper end 3 of the third body 30 to seal the upper bore 14 of the third body 30.

The side bore 35 of the third body 30 is in fluid communication with the side bore 68 of the second body 20, which are sealed by the seal 32. One or more alignment pins 44 are located in corresponding alignment pin holes 28, 34 of the second and third bodies 20, 30. The alignment pins 44 help align the second body 20 relative to the third body 30 when coupling the second and third bodies 20, 30 together.

A plunger 75 of the power end 70 sealingly extends into a chamber 69 of the second body 20 through the side bore 27. The plunger 75 is movable by the power end 70 and relative to the second body 20. The plunger 75 is repeatedly moved back and forth by the power end 70 (e.g. reciprocated) within the chamber 69 of the second body 20 to draw fluid into the second body 20 via the upper bore 67, and discharge fluid out of the second body 20 via the side bore 68.

The plunger 75 is at least partially retracted from the chamber 69 (although never fully retracted from the side bore 27 or the second body 20) to provide suction and move fluid into the chamber 69 through the upper bore 67 from the lower bore 66 of the first body 10. The plunger 75 is at least partially extended into the chamber 69 to pressurize and move the fluid within the chamber 69 out through the side bore 68 and into the side bore 35 of the third body 30. The power end 70 reciprocates the plunger 75 within the second body 20 to repeatedly to draw fluid in from the suction manifold 61 and discharge fluid out to the discharge manifold 63. The power end 70 and the plunger 75 increase the pressure of the fluid from the suction manifold 61 to the discharge manifold 63.

Although only one segmented fluid end module 100 is shown as part of the pump system 1000 in FIG. 6, the pump system 1000 may comprise one, two, three, four, five, six, or more segmented fluid end modules 100 that are coupled to the same suction manifold 61, discharge manifold 63, and power end 70. The multiple segmented fluid end modules 100 can be positioned side by side and coupled to each other. The power end 70 can reciprocate respective plungers 75 for each segmented fluid end module 100 to repeatedly to draw fluid in from the suction manifold 61 and discharge fluid out to the discharge manifold 63.

When maintenance and/or repair of the pump system 1000 and/or the segmented fluid end module 100 is required, the first body 10 can be uncoupled from the second body 20 (via the plurality of fasteners as described above) to access the internal components of the first body 10 and the second body 20, while the third body 30 remains coupled to the second body 20. Similarly the third body 30 can be uncoupled from the second body 20 (via the plurality of fasteners as described above) to access the internal components of the third body 30 and the second body 20, while the first body 10 remains coupled to the second body 20. The segmented connection between the first, second, and third bodies 10, 20, 30 via the plurality of fasteners allows for quicker and easier maintenance or repair of the pump system 1000 without having to disassemble the entire pump system 1000 and/or segmented fluid end module 100.

While the foregoing is directed to embodiments of the present disclosure, other and further embodiments of the disclosure may be devised without departing from the basic scope thereof, and the scope thereof is determined by the claims that follow.

The invention claimed is:

1. A segmented fluid end module, comprising:

a segmented first body comprising a bore formed through the segmented first body;

a segmented second body comprising a bore formed through the segmented second body; and a segmented third body comprising a bore formed through the segmented third body, wherein the segmented first body is coupled to an upper end of the segmented second body by a first plurality of fasteners that extend through the segmented first body, wherein the first plurality of fasteners comprise a plurality of threaded rods and nuts, wherein the nuts are recessed within an upper end of the segmented first body, wherein the bore of the segmented first body is in fluid communication with the bore of the segmented second body, wherein the segmented third body is the only body coupled to a side of the segmented second body by a second plurality of fasteners that extend through the segmented third body, and wherein the bore of the segmented third body is in fluid communication with the bore of the segmented second body.

2. The segmented fluid end module of claim 1, wherein a lower end of each first threaded rod threads into a corresponding bore formed in an upper end of the segmented second body.

3. The segmented fluid end module of claim 2, wherein a nut is threaded onto an upper end of each first threaded rod and against an upper end of the segmented first body to couple the segmented first body to the segmented second body.

4. The segmented fluid end module of claim 3, further comprising one or more alignment pins disposed in corresponding alignment pin holes formed in the segmented first body and the second body to align the segmented first body with the segmented second body.

5. The segmented fluid end module of claim 3, wherein the second plurality of fasteners comprises a plurality of second threaded rods.

6. The segmented fluid end module of claim 5, wherein a lower end of each second threaded rod threads into a corresponding bore formed in the side of the segmented second body.

7. The segmented fluid end module of claim 6, wherein a nut is threaded onto an upper end of each second threaded rod and against a side of the segmented third body to couple the segmented third body to the segmented second body.

8. The segmented fluid end module of claim 7, further comprising one or more alignment pins disposed in corresponding alignment pin holes formed in the segmented third body and the segmented second body to align the segmented third body with the segmented second body.

9. The segmented fluid end module of claim 3, wherein a lower end of the segmented first body is flush with the upper end of the segmented second body.

10. The segmented fluid end module of claim 9, wherein a side of the segmented third body is flush with the side of the segmented second body.

11. A pump system, comprising:

the segmented fluid end module of claim 1;

a suction manifold coupled to the segmented first body;

a discharge manifold coupled to the segmented third body; and a power end comprising a plunger that extends into the segmented second body.

12. The pump system of claim 11, further comprising a suction valve positioned in the segmented first body and configured to allow fluid flow through the bore of the segmented first body in one direction while preventing fluid flow in an opposite direction.

13. The pump system of claim 12, further comprising a discharge valve positioned in the segmented third body and configured to allow fluid flow through the bore of the segmented third body in one direction while preventing fluid flow in an opposite direction.

14. The pump system of claim 13, wherein the plunger is movable within the segmented second body to draw fluid into the second body from the suction manifold and discharge fluid out of the segmented second body to the discharge manifold.

15. The pump system of claim 1, wherein:

the bore of the segmented second body comprises an upper bore formed through the upper end of the segmented second body and a side bore extending through the segmented second body from the side which the segmented third body is coupled, to an opposite side of the segmented second body; and the bore of the segmented third body comprises a side bore in alignment with the side bore of the segmented second body such that fluid flows from the side bore of the segmented second body into the side bore of the segmented third body.

* * * * *